United States Patent [19]

Gics

[11] Patent Number: 4,617,440

[45] Date of Patent: Oct. 14, 1986

[54] MICROWAVE HEATING DEVICE

[76] Inventor: Paul W. Gics, 92 Merriman Rd., Sewickley Hights, Pa. 15143

[21] Appl. No.: 795,788

[22] Filed: Nov. 7, 1985

[51] Int. Cl.[4] ..... H05B 6/70

[52] U.S. Cl. ..... 219/10.55 A; 219/10.55 F; 333/22 F; 333/248; 333/254

[58] Field of Search ..... 219/10.55 F, 10.55 A, 219/10.55 E, 10.55 D, 10.55 R, 10.55 M; 333/22 F, 22 R, 113, 114, 230, 239, 254, 248; 34/1

[56] References Cited

U.S. PATENT DOCUMENTS

| | | | |
|---|---|---|---|
| 2,963,661 | 12/1960 | Seidel | 333/113 |
| 3,044,027 | 7/1962 | Chin et al. | 333/22 F |
| 3,622,732 | 11/1971 | Williams | 219/10.55 A |
| 3,983,356 | 9/1976 | Jurgensen | 333/22 F |
| 3,999,026 | 12/1976 | Böling | 219/10.55 A |
| 4,207,452 | 6/1980 | Arai | 219/10.55 A |
| 4,388,511 | 6/1983 | Sander et al. | 219/10.55 R |
| 4,476,363 | 10/1984 | Berggren et al. | 219/10.55 A |

FOREIGN PATENT DOCUMENTS

| | | | |
|---|---|---|---|
| 1277427 | 6/1972 | United Kingdom | 219/10.55 A |

*Primary Examiner*—Philip H. Leung
*Attorney, Agent, or Firm*—Lawrence Hager

[57] ABSTRACT

A microwave power head or modular heat applicating unit comprising a resonator, a waveguide, a source of microwave energy and a water load device. The constituent units or modular components of the power head are arranged in a sandwich like manner to form a readily repairable/replaceable microwave heat applicating device.

15 Claims, 5 Drawing Figures

MICROWAVE HEATING DEVICE

FIELD OF THE INVENTION

The present invention relates to a heating device which is fed with microwave energy and, more particularly, to a power head unit for heat sealing thermoplastic layers, packagings of paper or cardboard and the like.

PRIOR ART STATEMENT

Various types of microwave ovens and applicators have hitherto been proposed.

Typically, the prior art microwave heating devices used in the food packaging industry comprised a microwave energy source or magnitron positioned remote from the heat applicating resonator and a circulator device affixed within a waveguide for directing reflected-back energy to an elongate test tube like glass dummy load.

The present applicant discovered that the prior art devices when utilized for sealing packages, for example containing food, under a mass production environment, present costly time delays and difficulties to effect repairs and/or replacement of these devices. The cost factors involved are exacerbated due to the fact that the packaging/processing line is typically shutdown during the repair or replacement operation. Another serious disadvantage of the prior art units is the damage that may occur to the microwave energy source with dislodging of the resonator for periodic cleaning that may be required to remove splattered food particles.

Some prior art patents of interest include U.S. Pat. Nos. 3,999,026 issued Dec. 21, 1976 to Goran Boling; 4,160,145 issued July 3, 1979 to Werner Rudggeberg; 4,295,908 issued Oct. 20, 1981 to Hans G. Schaefer et al; 4,188,769 issued Feb. 19, 1980 to Marvin L. Bright, Jr.; 3,293,765 issued Dec. 27, 1966 to R. Winkler et al; 3,518,396 issued June 30, 1970 to T. L. Wilson et al; and 4,276,462 issued June 30, 1981 to Per O. Risman.

These patents are mentioned as being representative of the prior art and other pertinent references may exist. None of the above cited patents are deemed to affect the patentability of the present claimed invention.

The present invention involves a novel combination of features combined in such a way as to afford a solution to the difficulties and problems encountered with the prior art.

For example, in contrast to the prior art, the present invention provides a microwave energy heat applicator having its constituent parts arranged and configured to form a sandwich like structure to facilitate repair, cleaning, removal or replacement while substantially reducing the shutdown time and reducing or eliminating the risk of damage to the components of the heat applicator during maintenance thereto.

SUMMARY OF THE INVENTION

A modularized microwave heat applicator or power head assembly and system having particular utility for heat sealing food packagings or containers in a mass production environment, in combination comprising:

an elongate rectangular shaped waveguide (12) having an upper wall (29), a bottom wall (30), side walls (31,32), and end walls (33,34), said upper wall has a dummy load receiving hole (38) and a first antenna hole (37) each extending into an interior cavity (46) of the waveguide, said bottom wall has a second (35) and a third (36) antenna hole each extending into said interior cavity;

means (13) having a transmitting antenna (45) for providing microwave energy within said waveguide, said transmitting antenna being dimensioned for projecting downwardly through said first antenna hole and into the interior space of said waveguide;

a dummy load container means (14) having a fluid receiving cavity (57) defined by internal step like or sloped surface portions (58) to enable retension of a fluid dummy load so as to present a graduated termination to an electrical field within said waveguide;

resonator means (11) having an elongate rectangular configuration with an elongate slot (75), and having an elongate upper wall member (15) being readily attachable in elongate juxtaposition to said bottom wall of the waveguide, said upper wall member having a pair of spaced apart antenna receiving holes (23,27) each being aligned with a respective second and third antenna hole within said waveguide, said resonator being divided into at least two chambers by an elongate metal wall (20) supported along one edge by said upper wall member (15), said elongate metal wall having a pair of spaced apart V-shaped notches (22,26) each being aligned with a respective antenna receiving hole (35,36) a pair of antennae (21,24) each being affixed at one end to a portion of a respective V-shaped notch with its other end projecting within the interior cavity of said waveguide, each of said pair of antennae (21,24) has a coating of resins or other suitable material to function as a gasket and arc preventor means and effecting a snug-fit about the respective second and third antenna holes within said waveguide.

Accordingly, it is an object of the present invention to provide a new and improved heating device fed with microwave energy.

It is a further object of the present invention to provide a microwave system having a modularized power head unit.

It is a further object of the present invention to provide microwave energy system for sealing containers under mass production requirements.

It is a further object of the present invention to provide a microwave heat applicating assembly that is reaadily repairable.

It is a further object of the present invention to provide a modular heat applicating device to facilitate repairs, replacement and cleaning of the constituent components.

BRIEF DESCRIPTION OF THE DRAWINGS

Other objects and advantages of the present invention will be evident from the following detailed description when read in conjunction with the accompanying drawings which illustrate the preferred embodiment of the present invention. Similar reference numerals refer to similar parts throughout.

DESCRIPTION OF THE PREFERRED EMBODIMENT

Figure 5:
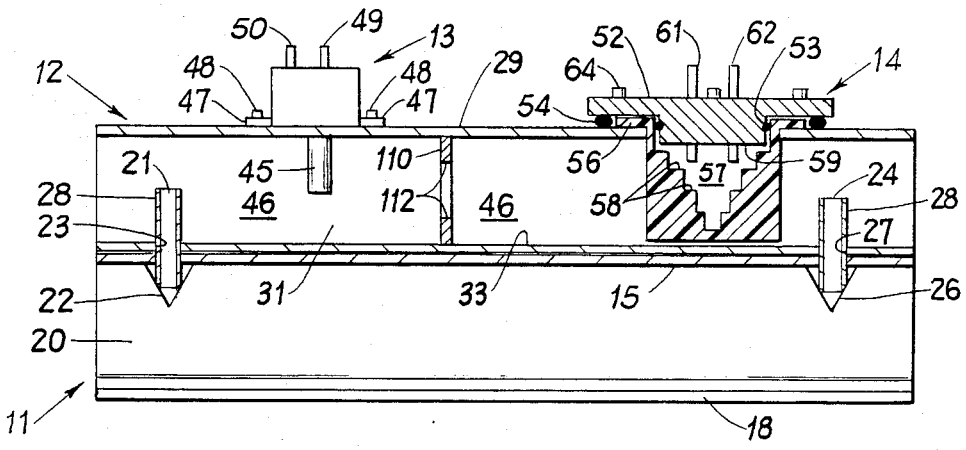
FIG. 5 is a longitudinal sectional view of the microwave power head illustrated in FIG. 4 taken along line A—A.

Reference will now be made to the drawings, and in particular to FIG. 5 in which there is shown an exploded view of the microwave power head 10. Basically speaking, the microwave power head 10 comprises a resonator 11, a waveguide 12, a source of microwave energy 13, and a dummy load container device 14.

The resonator 11 has a generally elongate rectangular configuration comprising a top wall 15, side walls 16 and 17, two partial walls 18 and 19, and a center wall or hot-tongue member 20. The center wall 20 basically divides the resonator 11 into two chambers and is affixed in an upright manner to top wall 15 or is formed integrally as a downwardly projecting wall portion.

The microwave energy is coupled into the resonator by means of a receiving antenna 21. The receiving antenna 21 is connected to a V-shaped slot 22 (ss FIG. 5) in the center wall 20, and projects upwardly through an opening 23 in top wall 15.

A second antenna 24 is connected to V-shaped slot 26 in center wall 20, and also projects upwardly through an opening 27 in top wall 15.

Each antenna 21 and 24 is coated with a protective shield 28 such as plastic or synthetic flourine containing resins to function as a gasket and arc suppressor.

Waveguide 12 has an elongate rectangular configuration comprising top wall 29, bottom wall 30, side walls 31 and 32, and end walls 33 and 34. Bottom wall 30 has a pair of spaced apart holes 35 and 36 each dimensioned and located for receiving antenna 21 and 24, respectively. Antennae 21 and 24 and/or their respective plastic coatings may be tapered to facilitate insertion into its respective receiving hole 35 and 36. The diameter of antenna 21 and 24 with its plastic coating is dimensioned and configured to effect a snug fit within its respective receiving hole 35 and 36, with the power head 10 being in the assembled state (see FIGS. 4 and 5). Top wall 29 has an antenna receiving hole 37 and a dummy load receiving hole 38. The width 39 of waveguide 12 is approximately equal to the width 40 of resonator 11. A pair of alignment pins 41 and 42 project downwardly from bottom wall 30 and are positioned for being received within an alignment hole 43 and 44, respectively, within top wall 15 of resonator 11. The alignment pins 41 and 42 serve a dual function of facilitating assembly and of providing protection to antennae 21 and 24 against any sheering disposition between resonator 11 and waveguide 12.

The source of microwave energy or magnetron 13 may be of conventional design and has a transmitting antenna 45 dimensioned for being inserted within hole 37 of waveguide 12 such that it projects within cavity 46 of waveguide 12. Magnetron 13 may be mounted to waveguide 12 in conventional manner, for example, by means of mounting brackets 47, bolts 48 and bolt receiving holes 49 in waveguide 12. Magnetron 13 has a fluid inlet and outlet port 50 and 9 to enable fluid (water) cooling of the magnetron 13 in conventional manner.

The dummy load device 14 comprises a cup or jar shaped container 51, a cover member 52, a first O-ring gasket 53 and a second O-ring gasket 54. Container 51 has a downwardly extending circular fluid (water) receptacle member 55 and a circular upper ledge member 56. Receptacle member 55 has an interior cavity 57 defined by a plurality of circular wall portions 58 of decreasing diameter from top to bottom to effect a sloping or stepped interior wall surface. In this manner, a fluid dummy load, for example, water, having a sloping surface may be presented to an electrical field within waveguide cavity 46. The outer diameter of receptacle member 55 is dimensioned to fit into waveguide hole 38. Ledge member 56 is dimensioned to extend beyond the surface portions of waveguide 12 defining hole 38 and for abutting atop waveguide wall 29. In this manner, receptacle member 55 may be readily inserted into and removed from waveguide hole 38. Receptacle member 55 may be formed of any suitable material such as plastic, glass or various resins. O-ring 53 may be of conventional design and construction having an outer diameter slightly greater than the diameter of the lower cap member 59 (see FIG. 5) of cover member 52. Cover member 52 has a generally circular plate shape with a downwardly projecting cap member 59. Cap member 59 has a circumferential notch 60 for receiving O-ring 53. Cover member 52 may be formed of any suitable metal such as aluminum. An inlet and outlet port 61 and 62 are provided to enable the circulation of coolant, for example, water, to be pumped (not shown) into and out of receptacle member 55. O-ring 54 has an inner diameter greater than the diameter of ledge member 56 of dummy load device 51 and less than the diameter of cover member 52. O-ring 54 may include metallic strands to form a shield to prevent or substantially reduce any microwave energy leakage about the dummy load device 14.

Figure 4:
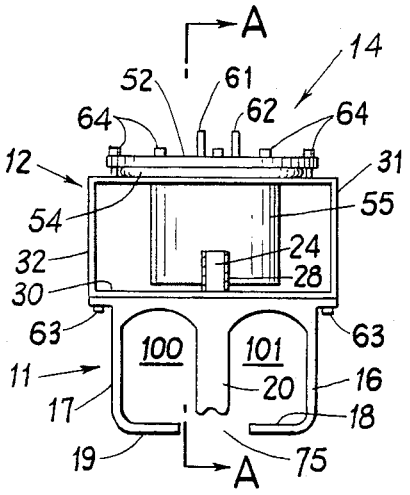
FIG. 4 is an end view, with its end wall member removed, of the microwave power head illustrted in FIG. 1 in the assembled state.

With particular reference now to FIG. 4, an end view of the assembled microwave power head 10 is shown with end wall 33 removed. Waveguide 12 is placed in longitudinal alignment atop resonator 11. Waveguide 12 may be clamped or affixed to resonator 11 by any conventional means such as bolts 63 or a toggle clamp means (not shown). The ledge member 56 is placed in abutment atop wall 29 of waveguide 12. Cover member 52 is placed over ledge member 56 and is clamped or affixed to waveguide 12 by a plurality of bolts 64 and mating holes 65 and 66, or other suitable conventional means. O-ring 54 is compressed between cover member 52 and top wall member 29 of waveguide 12.

With particular reference now to FIG. 5, a cross sectional view of the microwave power head assembly 10 is illustrated. As noted above, receptacle member 55 extends within waveguide cavity 46. The interior surface of receptacle member 55 is stepped 58. With cover member 52 affixed to waveguide 11 as shown, cap member 59 fits within the upper opening 67 of cavity 57. O-ring 53 fits between notch 60 and the circumferential walls forming opening 67, O-ring 53 forms a seal between receptacle member 55 and cover member 52. O-ring 54 is formed of conventional material to effect a shielding about ledge member 56 with being compressed between waveguide wall 29 and cover member 52.

Figures 1, 2, 3:
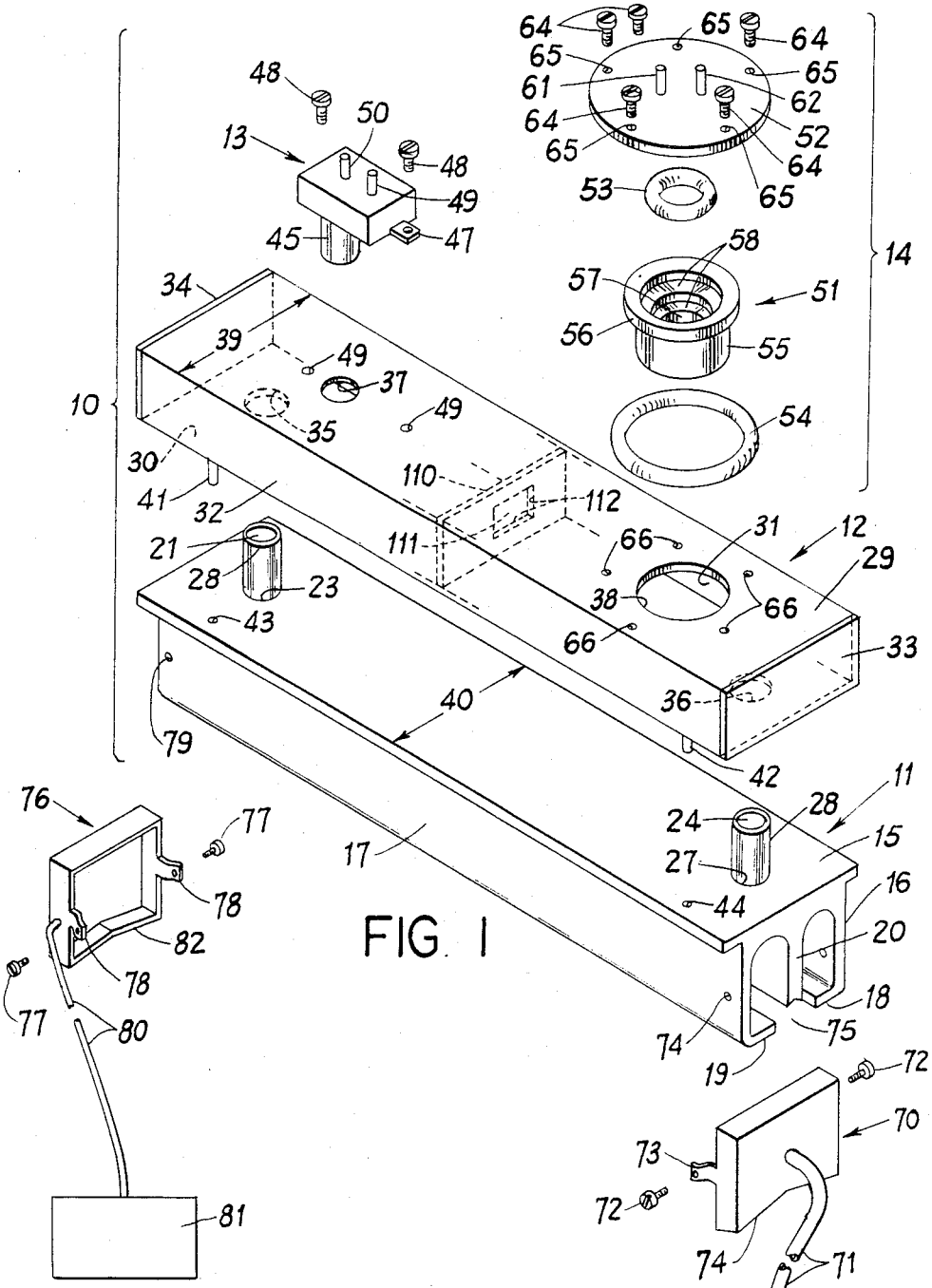
FIG. 1 is an exploded view, partly in phantom, of the microwave power head in accordance with the invention.
FIG. 2 is a diagrammatic illustration of a vacuum device attachment for the microwave power head.
FIG. 3 is a diagrammatic illustration of a spray attachment for the microwave power head.

With reference now to FIGS. 2 and 3, additional (optional) attachments to assembly/system 10 are illustrated. End spray attachment 70 comprises a fluid or cleansing liquid spray nozzle (not shown). The spray nozzle is operatively connected, via tubing or hoses 71, to a source of water 72 and/or other suitable cleansing solution. Spray attachment 70 may be mounted in juxtaposition at a first end of resonator 11 by conventional means such as bolt(s) 72 and brackets 73 and mating hole(s) 74. The spray nozzle directs the cleansing solution into and longitudinally through resonator 11 for cleaning debris from the wall surfaces thereof. The bottom surface 74 of spray attachment 70 may be contoured to aid or facilitate guiding food container edges etc. to be heat sealed into the longitudinal slot 75 of resonator 11.

A vacuum device 76 may be mounted, for example, by means of bolts 77, brackets 78 and mating holes 79. Vacuum device 76 is connected, via hose 80 to a vacuum or suction pump 81. The bottom surface 82 of vacuum device 76 may be contoured to substantially prevent jamming of the sealed package (not shown) at the exiting or end section of resonator 11.

With spray attachment 70–72 and vacuum device 76,81 being selectively/periodically activated, resonator 11 may be washed/sprayed and any resulting debris substantially removed by vacuum device 76. Of course, the cleaning operation is effected when the resonator 11 is deenergized or the sealing operation is interrupted.

With reference once again to FIGS. 1 and 5, partition wall 110 (shown in phantom outline in FIG. 1) is provided within waveguide 12 intermediate between transmitting antenna 45 and dummy load device 14. Partition wall 110 has a generally center energy passage window 111. The wall portions 112 defining window 111 may be tapered to have a first opening facing transmitting antenna 45 and a second opening facing receptacle member 55. Said first opening being of greater size than said second opening. The size of said first and second openings of window 111 and, therefore, the slope of tapered or contoured walls 112 may be determined empirically to effect best operating results. The purpose of partition wall 110 is to provide a microwave energy block to substantially prevent the microwave energy transmitted by antenna 45 from traveling along waveguide 12 to dummy load 14 during periods when the resonator 11 is being utilized to heat a package (not shown) etc., i.e., with thermoplastic layers being inserted between walls 18 and 19 of resonator 11. During such periods the dimension and/or tapering of window 111 relative to the (loaded) frequency and strength of the microwave energy is such that virtually no or relatively little leakage microwave energy is coupled, via window 111, to dummy load 14. However, during unloaded periods of operation of resonator 11, i.e., no package is being heat sealed, the (unloaded) frequency and/or strength of the microwave energy within waveguide chamber 46 relative to the dimension and configuration of window 111, to effect a substantial energy (leakage) path, via window 111 and waveguide chamber 46, to the dummy load 14 to enhance unwanted energy dissipation.

It is to be understood that the above described embodiment is illustrative of the application of the principles of the present invention. Other arrangements may be devised by those skilled in the art without departing from the spirit and scope of the claimed invention. For example, waveguide 12 may contain an intermediate partition wall between antenna hole 37 and hole 38. On the other hand, elongate waveguide 12 could be replaced by two separate waveguide sections, with the first accommodating antennae 21 and 45 within its cavity, and a second section accommodating antenna 24 and dummy load container 55.

I claim:

1. A microwave heater assembly, in combination comprising:

elongate waveguide means defining a waveguide cavity therein, said elongate waveguide means having a first and a second antenna receiving holes extending into said waveguide cavity, and having a dummy load receiving hole extending into said waveguide cavity;

elongate resnator means mounted in elongate juxtaposition to said waveguide means, said resonator means having an elongate center wall member with a resonator antenna means projecting through said first antenna receiving hole and within said waveguide cavity;

microwave energy source means mounted to said waveguide means and having a transmitting antenna means projecting through said second antenna receiving hole and within said waveguide cavity; and dummy load means mounted to said waveguide means and having a fluid container member projecting through said dummy load receiving hole and within said waveguide cavity, said fluid container member having a fluid receiving cavity defined by a plurality of internal wall surface portions with at least one of said internal wall surface portions having a predetermined slope.

2. A microwave heater assembly as in claim 1, wherein:

the resonator means has an elongate rectangular shaped metal housing open at both ends and having an elongate slot, said center wall member being integrally formed within said housing with a free elongate edge portion being generally parallel and proximate with said elongate slot.

3. A microwave heater assembly as in claim 1, wherein:

the dummy load comprises a cup shaped member having an upper ledge portion for extending beyond the surface portions of said waveguide means defining said dummy load receiving hole for being mounted atop and without said waveguide means with the cup shaped member projecting into said waveguide cavity.

4. A microwave heater assembly as in claim 1, wherein:

the resonator antenna means is coated with a plastic material and dimensioned to have a snug fit within said first antenna receiving hole to function as a gasket like element.

5. A microwave heater assembly as in claim 1, wherein:

the dummy load means includes a metal cover member for substantially preventing microwave energy leakage from said waveguide means about the dummy load means.

6. A microwave heater assembly as in claim 1, including:

a spray attachment means removably mounted to one end of said resonator means.

7. A microwave heater assembly as in claim 1, including:

a vacuum attachment means removably mounted to one end of said resonator means.

8. A microwave heater assembly as in claim 1, wherein:

the resonator antenna means is coated with a synthetic flourine containing resin material.

9. A microwave heater assembly, comprising;

waveguide means defining a waveguide cavity therein, said waveguide means having wall portions forming a plurality of holes extending into said waveguide cavity;

microwave energy resonator means removably mounted to said waveguide means and having one or more antenna means each projecting through a respective one of said plurality of holes in said waveguide means, a protective coating being provided on a portion of said antenna means;

a magnetron being removably mounted to said waveguide means and having a transmitting antenna projecting through a respective one of said plurality of holes in said waveguide means; and dummy load means removably mounted to said waveguide means and having a container means projecting through a respective one of said plurality of holes in said waveguide means, said container means having wall portions defining a contoured fluid receiving cavity to enable retension of a fluid dummy load for presenting a graduated termination to an electrical field within said waveguide means.

10. A microwave heater assembly as in claim 9, including:

a plurality of alignment pin means projecting outwardly from said waveguide means; and a plurality of alignment pin receiving holes formed in said microwave energy resonator means for receiving a respective one of said plurality of alignment pin means.

11. A microwave heater assembly as in claim 10, including:

a solution spray means affixed to one end of said microwave energy resonator means.

12. A microwave heater assembly as in claim 10, including:

a vacuum means affixed to one end of said microwave energy resonator means.

13. A microwave heater assembly as in claim 9, including:

a solution spray means affixed to a first end of said microwave energy resonator means, and a vacuum means affixed to the other end of said microwave energy resonator means.

14. A modularized microwave heat applicator assembly having particular utility for heat sealing food packagings in a mass production environment, in combination comprising:

an elongate rectangular shaped waveguide (12) having an upper wall (29), a bottom wall (30), side walls (31,32), and end walls (33,34), said upper wall has a dummy load receiving hole (38) and a first antenna hole (37) each extending into an interior cavity (46) of the waveguide, said bottom wall has a second (35) and a third (36) antenna hole each extending into said interior cavity;

means (13) having a transmitting antenna (45) for providing microwave energy within said waveguide, said transmitting antenna being dimensioned for projecting downwardly through said first antenna hole and into the interior space of said waveguide;

a dummy load container means (14) having a fluid receiving cavity (57) defined by internal step like or sloped surface portions (58) to enable retension of a fluid dummy load so as to present a graduated termination to an electrical field within said waveguide;

resonator means (11) having an elongate rectangular configuration with an elongate slot (75), and having an elongate upper wall member (15) mounted in elongate juxtaposition to said bottom wall of the waveguide, said upper wall member having a pair of spaced apart antenna receiving holes (23,27) each being aligned with a respective second and third antenna hole within said waveguide, said resontor being divided into at least two chambers by an elongate metal wall (20) supported along one edge by said upper wall member (15), said elongate metal wall having a pair of spaced apart V-shaped notches (22,26) each being aligned with a respective antenna receiving hole (35,36), a pair of antennae (21,24) each being affixed at one end to a portion of a respective V-shaped notch with its other end projecting within the interior cavity of said waveguide, each of said pair of antennae (21,24) has a coating of resins or other suitable material to function as a gasket and arc preventor means and effecting a snug-fit about the respective second and third antenna holes within said waveguide.

15. A microwave heat applicator unit as in claim 14, including:

a solution spray nozzle means (70) removably mounted at one end of said resonator means for periodically spraying a fluid within said resonator chambers for washing debris therefrom; and a suction means (76) removably mounted at the other end of said resonator means to periodically suction debris and sprayed fluid from said resonator chambers.

* * * * *